US007234252B2

(12) United States Patent
Jarnecke et al.

(10) Patent No.: US 7,234,252 B2
(45) Date of Patent: Jun. 26, 2007

(54) METHOD AND APPARATUS FOR BENEFICIATING SOILS DURING VACUUM EXCAVATION

(76) Inventors: Dennis R. Jarnecke, 7714 Division St., River Forest, IL (US) 60305; Hyman Aaron Todres, 8920 Tamaroa Ter., Skokie, IL (US) 60076

( * ) Notice: Subject to any disclaimer, the term of this patent is extended or adjusted under 35 U.S.C. 154(b) by 287 days.

(21) Appl. No.: 10/972,500

(22) Filed: Oct. 25, 2004

(65) Prior Publication Data

US 2006/0086010 A1 Apr. 27, 2006

(51) Int. Cl.
*E02F 3/88* (2006.01)

(52) U.S. Cl. ..... 37/322; 37/323; 175/67; 406/153

(58) Field of Classification Search ..... 37/307, 37/317, 318, 322, 323; 175/66, 67, 424, 175/324, 213; 406/88, 96, 162, 153, 167
See application file for complete search history.

(56) References Cited

U.S. PATENT DOCUMENTS

| | | | | |
|---|---|---|---|---|
| 4,936,031 | A * | 6/1990 | Briggs et al. | 37/347 |
| 5,016,717 | A * | 5/1991 | Simons et al. | 175/66 |
| 5,140,759 | A * | 8/1992 | Artzberger | 37/347 |
| 5,295,317 | A * | 3/1994 | Perrott | 37/348 |
| 5,299,370 | A * | 4/1994 | Gyori et al. | 37/347 |
| 5,408,766 | A * | 4/1995 | Pobihushchy | 37/323 |
| 5,860,232 | A * | 1/1999 | Nathenson et al. | 37/466 |
| 6,000,151 | A * | 12/1999 | Hayes | 37/323 |
| 6,470,605 | B1 * | 10/2002 | Gilman et al. | 37/323 |
| 6,604,304 | B1 | 8/2003 | Slabach et al. | |
| 6,691,436 | B2 * | 2/2004 | Chizek, Sr. | 37/322 |
| 6,751,893 | B2 * | 6/2004 | Sullivan et al. | 37/195 |
| 6,857,207 | B1 * | 2/2005 | Adler | 37/195 |
| 2006/0086010 | A1 * | 4/2006 | Jarnecke et al. | 37/317 |

* cited by examiner

*Primary Examiner*—Thomas A Beach
(74) *Attorney, Agent, or Firm*—Mark E. Fejer

(57) ABSTRACT

An apparatus for soil excavation having a vacuum hose, a vacuum holding tank and at least one air lance and/or water jet, in which a soil beneficiating agent is introduced into the soil during one or more of the steps of the vacuum excavation process.

15 Claims, 1 Drawing Sheet

METHOD AND APPARATUS FOR BENEFICIATING SOILS DURING VACUUM EXCAVATION

BACKGROUND OF THE INVENTION

1. Field of the Invention

This invention relates to a method and apparatus for improving one or more soil characteristics during vacuum excavation of the soil, thereby improving the replaceability of the soil upon completion of the project necessitating excavation of the soil. More particularly, this invention relates to a method and apparatus for beneficiating soil during one or more of the steps employed in vacuum excavation of the soil.

2. Description of Related Art

In order to install or access already-installed underground facilities, such as pipelines and the like, it is often necessary to excavate in pavements, sidewalks and other locations. Vacuum excavation as a means for the removal of dirt, water or other material from an excavation site is well known. Vacuum excavation is widely considered to be superior to traditional excavation techniques such as manual or mechanical digging, primarily due to the reduced risk of damage to underground facilities that may be present at the excavation site. Vacuum excavation typically involves the use of a vacuum system to pull a slurry or debris stream that may exist or that may be created by the use of mediums capable of loosening hard-packed material. For example, loosening of the hard-packed material may be achieved through the use of air lances or water jets, which inject air or water under high-pressure into the hard-packed material. The use of air lances and water jets for loosening the soil virtually precludes the possibility of damage to the underground pipelines or other buried utilities. Important applications for vacuum excavation systems include environmental cleanup and the collection of slurry created in the process of directional drilling. Vacuum excavation is particularly useful in small excavations such as the "potholing" or "keyholing" of utilities. Potholing and keyholing refers to the excavation of a hole to access or repair utilities. Potholing and keyholing are preferred over prior art techniques such as digging shovels, backhoes, and the like which often result in damage to the utilities and the corresponding demand for expensive repair and reconstruction. In addition to the increased costs associated with damage repair and increased labor costs associated with digging, such damage may present danger to workers or others in the immediate vicinity of the excavation. When vacuum excavation is utilized for potholing and keyholing, access is possible without risk of damage to the utilities. In addition, such small excavations provide the benefit of working from the surface.

Exemplary of the prior art existing with respect to the technique of vacuum excavation are U.S. Pat. No. 5,016,717 to Simmons et al., which teaches a vehicle mounted vacuum excavation system having a tank mounted on a lift mechanism to facilitate the raising and tilting of the tank to release excavated materials by dumping through an openable rear hatch or end wall of the tank in which a vibrator is used to prevent compaction of particles within the tank to facilitate release when the tank is tilted for dumping; U.S. Pat. No. 5,295,317 to Perrott which discloses a mobile vacuum excavation system and tank featuring a slurry water recovery system to reuse excavation water; and U.S. Pat. No. 6,604,304 B1 to Slabach et al., which teaches a vacuum excavation system utilizing pneumatic or hydraulic agitation of the holding tank to suspend vacuum-excavated materials for release, thereby facilitating the efficient emptying of the tank.

Backfill of an excavation and restoration of the pavement or sidewalk structures upon completion of the job for which the excavation was carried out ideally includes the replacement of suitable excavated soil, compacted to engineering specifications or to match pre-existing density. However, the soil may not be suitable for such purpose due, for example, to high clay content, and/or the soil may not be amenable to compaction due to excess or inadequate moisture and/or high clay content. In such cases, stabilization and/or beneficiation of the soil is required to render the soil more suitable for such purposes. If it is not stabilized or beneficiated, the soil must be hauled away and replaced with imported select material, adding significant dollar and environmental costs to the restoration.

Traditional mechanical methods of stabilizing soils are best suited for large-scale work in which it is practicable to set up and operate on-site the large equipment needed. Alternatively, centralized plants can be operated, but this requires transporting unstabilized materials from the point of excavation to the plant and transporting stabilized materials back to the excavation. Small excavations typically are poorly served by such methods. On the other hand, manual methods for stabilizing are often impractical, for example in heavy clays, and are labor-intensive, slow and have limited productivity.

The use of soil beneficiating agents that operate by means of one or a combination of direct chemical reaction, ion exchange, cementing action, dilution effects, gradation changes and the like may make the excavated soil suitable for backfill. For example, hydrated lime through ion exchange has long been used as a beneficiating agent for clays, and Portland cement has long been used to provide additional strength through cementing action. As another example, dry sand has been used to reduce overall moisture content and improve overall gradation when mixed with wet fine-grained soil. In all cases, intimate and thorough mixing are important, and this is assisted by breaking the soil into small pieces, thereby enlarging the amount of surface area available for beneficiation and reducing the distance the beneficiating agent has to travel to the interior for chemical and other effects to occur. Traditionally, mixing of the beneficiating agent with the original soil is usually performed after excavation of the soil in mechanical devices such as pug mills, and sometimes by hand with shovels. When large areas are involved, disc harrows or similar mechanical methods are employed. However, each of these traditional means requires the performance of a separate step and additional equipment.

SUMMARY OF THE INVENTION

It is, thus, one object of this invention to provide an apparatus for vacuum excavation of soils which enables soil beneficiation without employing the additional equipment, such as pug mills, utilized by conventional soil beneficiation methods.

It is another object of this invention to provide an apparatus for vacuum excavation of soils which enables simultaneous excavation and beneficiation of the soil.

It is another object of this invention to provide an apparatus for vacuum excavation which enables reuse of the excavated soil, thereby eliminating the need for transporting spoil and new backfill material.

These and other objects of this invention are addressed by an apparatus for soil excavation comprising vacuum excavation means for removing soil using suction and beneficiating means for beneficiating the soil during the soil excavation. More particularly, the apparatus of this invention comprises a vacuum hose having a soil inlet end and a soil outlet end, a vacuum pump adapted to pull soil into and through the vacuum hose, a vacuum holding tank for temporary storage of the excavated soil in fluid communication with the soil outlet end of the vacuum hose, and soil loosening means, which may be in the form of mechanical means, such as spades, pry bars and the like, or in the form of one or more air lances or water jets. In accordance with one embodiment of this invention, the apparatus of this invention comprises means for introduction of a beneficiating agent into the soil during the soil loosening process by incorporation of the beneficiating agent into the air or water stream of the loosening device. In accordance with another embodiment of this invention, the apparatus comprises means for introduction of a beneficiating agent into the soil during conveyance of the soil through the vacuum hose. In accordance with yet a further embodiment of this invention, the apparatus comprises means for introduction of a beneficiating agent in the vacuum holding tank or chamber.

It will be apparent that the invention disclosed herein can be applied to individual components of, or alternative means of, loosening, excavating, and conveying the soil, in addition to air lances, water jets and vacuum excavation. It will further be apparent that the beneficiating agent can be applied in dry form, in solution, in suspension, or any combination thereof. In addition, use can be made of the positive or negative pressures in various parts of the process to cause and/or aid the flow and/or metering of the beneficiating agent.

The choice of beneficiating agent is most affected by soil type. Beneficiating agent selection and application rates vary with soil characteristics. The product type and application rate can be recommended based on test results and field conditions.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

Figure 1:
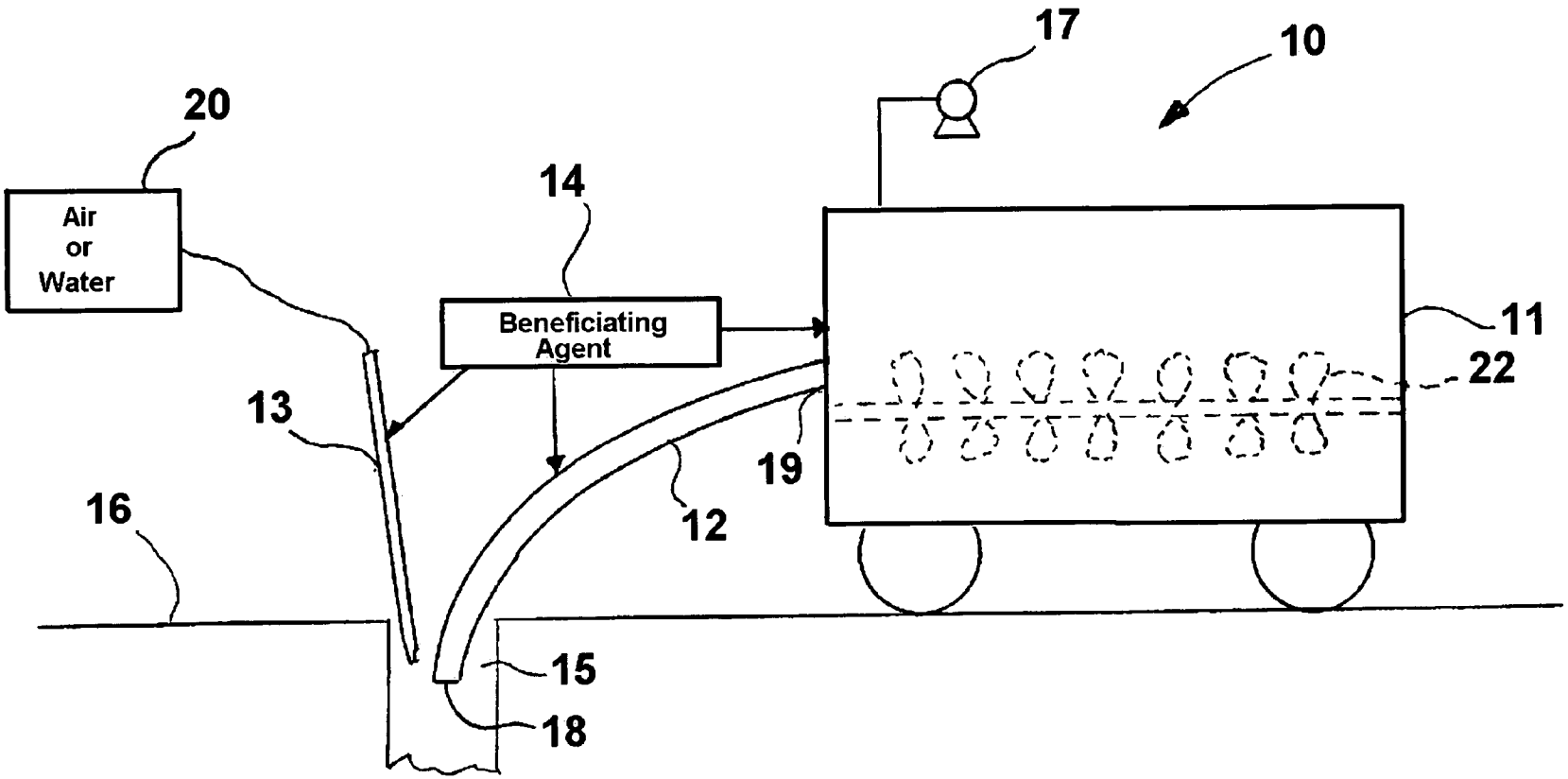
FIG. 1 is a general diagram of a vacuum excavation system in accordance with one embodiment of this invention.

The invention disclosed and claimed herein is a method and apparatus for vacuum excavation of soils in which the soil undergoing excavation is treated by one or more beneficiating agents to render it suitable for reuse, for example as backfill in the excavation site. Treatment of the soil involves the addition of one or more soil stabilization or beneficiation agents to the soil during one or more of the vacuum excavation process steps. For the purpose of simplicity in describing this invention, the term "beneficiating agent" or "beneficiation agent" as used herein refers to any agent, such as chemicals, dry sand, water and the like, added to the soil which improves the quality of the soil so as to enable its reuse. Accordingly, as used herein, this term includes agents employed for the purpose of stabilizing the soil as well as agents which provide other beneficial characteristics.

As indicated herein above, the process of vacuum excavation comprises three basic steps: 1) loosening of the soil prior to vacuuming, 2) suctioning of the loosened soil out of the ground, and 3) storing of the excavated soil. Thus, the crux of this invention is the addition of one or more beneficiating agents to the soil during the loosening step, the suctioning step, and/or the storing step. Several benefits derive from the apparatus and method of this invention. Firstly, the soil is beneficiated and excavated in a single step as opposed to the conventional method of removing the soil and mixing the beneficiating agent in a different area or location. Secondly, the ability to use vacuum excavation in larger soil excavation projects is greatly enhanced due to the reuse of the soil, thereby eliminating the need for transporting spoil and new backfill. Thirdly, using a vacuum unit to excavate and beneficiate the excavated soil eliminates the need for backhoes to perform the excavation, in turn reducing the disruption and the time and expense associated with restoration and mixing of the beneficiating agents, both for large-scale centralized or on-site mechanical operations, or for manual mixing on-site.

FIG. 1 is a diagram showing a vacuum excavation system in accordance with one embodiment of this invention. As shown therein, the system 10 comprises a vacuum hose 12 having a soil inlet end 18 for receiving loosened soil from within hole 15 in ground 16 and a soil outlet end 19, a vacuum storage or holding tank 11 adapted to receive excavated soil from the soil outlet end 19 of vacuum hose 12, loosening means 13 in the form of an air lance or knife or water jet operably connected to an air or water source 20 or in the form of spades or pry bars (not shown), and a beneficiating agent source 14 adapted to deliver at least one beneficiating agent into the fluid employed by loosening means 13, into vacuum hose 12 as the excavated soil is being sucked therethrough, and/or into vacuum storage or holding tank 11.

Suitable beneficiating agents for beneficiating soil are well-known to those skilled in the art. Such beneficiating agents function in a variety of manners including direct chemical reaction, ion exchange, cementation, dilution effects and gradation changes. Such beneficiating agents may be applied in dry form, in solution, in a suspension, or in any combination thereof. The choice of beneficiating agents is most affected by soil type as is the application rate. Accordingly, the most suitable beneficiating agents for use in a given excavation, as well as the application rate thereof, should be determined based on test results and field conditions at the excavation site. It will be appreciated by those skilled in the art that any beneficiating agent able to be mixed with the soil during the vacuum excavation process may be employed in the method and system of this invention. Examples of suitable beneficiating agents include hydrated lime, Portland cement, dry sand, fly-ash, lime-fly ash, cement-fly ash, lime-cement, lime-cement-fly ash, bitumen, asphalt, lime-bitumen, calcium chloride, cement kiln dust and combinations thereof. Several are combination treatments and, in some cases, may involve a two-step process (e.g. lime-bitumen, in which the soil is first treated with lime, which makes the material more amenable to treatment by bitumen). It will, however, also be appreciated by those skilled in the art that the reuse of the excavated soil mandates selection criteria for suitable beneficiating agents to include environmental considerations.

As previously indicated, the beneficiating agent can be introduced into the excavated soil in one or any combination of three ways or elements of the process. If the beneficiating agent is introduced into the vacuum hose, mixing of the beneficiating agent with the soil passing through the vacuum hose may be enhanced by the use of active or passive mechanical means, in addition to the natural turbulence effects of conveying. If the beneficiating agent is introduced into the vacuum storage or holding tank, mechanical mixing by pug mill, paddles or other such means may be employed. In all cases, the initial breakdown of the excavated soil into relatively small chunks is taken advantage of, but breakdown may be enhanced at later stages by additional means, including, but not necessarily limited to, mechanical mixing devices 22 in the vacuum storage or holding tank 11. In addition, in those instances in which soil treatment involves the use of a combination of beneficiating agents, e.g. lime-bitumen, one of the agents may be introduced into the soil in one of the steps of the vacuum excavation process and another of the agents may be introduced into the soil in a different step of the vacuum excavation process.

By way of example, in the vacuum excavation of wet clay, a preferred beneficiating agent is hydrated lime which is entrained into the air supply going to the air lance. This entrainment can be done using a "tee" connector and attaching a pressurized vessel containing the hydrated lime to a pipe going to the tee. A valve or other metering device in-line with the pipe going to the tee can regulate the rate of lime entering into the air lance. The air and particles leave the air lance at high velocities, impacting upon and breaking the clay apart. The disrupted clay and lime is then suctioned into the vacuum hose for further mixing. By the time the soil has reached the vacuum tank, the lime has been thoroughly mixed with the wet clay.

In accordance with another embodiment of this invention, a pressurized container of lime or other additive is connected to a small diameter hose that is attached to the outside of the vacuum hose. This interjection hose has its termination at the end of the vacuum hose, where the lime is sprayed. As the vacuum hose suctions up soil, it also vacuums up the expressed lime.

In accordance with yet another embodiment of this invention, the beneficiating agent is injected further up the vacuum hose toward the vacuum tank. In this embodiment, a metering device dependent on the vacuum pressure, or the weight of material in a section of the hose, regulates the amount and rate of the beneficiating agent entering the vacuum hose.

In accordance with a further embodiment of this invention, deflection paddles or plates, which act to further break up the excavated soil by the action of the soil clumps impacting the plates and breaking apart, are disposed in a segment of the vacuum hose.

In accordance with yet another embodiment of this invention, the apparatus comprises powered mixing paddles disposed within the vacuum tank that act to stir and mix the excavated soil and the beneficiating agents.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of this invention.

We claim:

1. In an apparatus for soil excavation comprising vacuum excavation means for removing soil using suction, the improvement comprising:

beneficiating means for beneficiating said soil during said soil excavation, said beneficiating means comprising at least one beneficiating agent which beneficiates said soil by means of a method selected from the group consisting of direct chemical reaction, ion exchange, cementation, dilution, gradation changes and combinations thereof, said beneficiating agent selected from the group consisting of hydrated lime, Portland cement, sand and mixtures thereof; and said vacuum excavation means comprising at least one vacuum hose having a soil inlet end and a soil outlet end, a vacuum pump operably connected to said at least one vacuum hose whereby said soil is sucked through said soil inlet end into said at least one vacuum hose, a vacuum holding tank having a tank soil inlet in fluid communication with said soil outlet end, and soil loosening means for loosening said soil prior to applying said suction.

2. An apparatus in accordance with claim 1, wherein said loosening means comprises fluid injection means for injecting a pressurized fluid into said soil.

3. An apparatus in accordance with claim 2, wherein said at least one beneficiating agent is disposed within said pressurized fluid.

4. An apparatus in accordance with claim 1, wherein said beneficiating means comprises injection means for injecting said at least one beneficiating agent into said soil as it passes through said at least one vacuum hose.

5. An apparatus in accordance with claim 4 further comprising mixing means for mixing said soil with said at least one beneficiating agent within said vacuum hose.

6. An apparatus in accordance with claim 1, wherein said beneficiating means comprises means for introducing at least one beneficiating agent into said vacuum holding tank.

7. An apparatus in accordance with claim 1 further comprising mixing means for mixing said soil with a beneficiating agent, said mixing means disposed in at least one of said vacuum hose and said vacuum holding tank.

8. An apparatus in accordance with claim 2, wherein said pressurized fluid is selected from the group consisting of water, air and mixtures thereof.

9. A method for excavation of soil comprising the steps of:

loosening soil to be excavated, forming loosened soil;

sucking said loosened soil through a vacuum hose into a vacuum storage tank;

storing said loosened soil in said vacuum storage tank; and introducing at least one beneficiating agent selected from the group consisting of hydrated lime, Portland cement, sand and mixtures thereof into said soil during at least one of said loosening step, said sucking step, and said storing step.

10. A method in accordance with claim 9, wherein said soil is loosened by injection of a pressurized fluid into said soil.

11. A method in accordance with claim 10, wherein said pressurized fluid is selected from the group consisting of air, water and mixtures thereof.

12. A method in accordance with claim 10, wherein said at least one beneficiating agent is mixed with said pressurized fluid.

13. A method in accordance with claim 9, wherein said at least one beneficiating agent is introduced into said vacuum hose.

14. A method in accordance with claim 9, wherein said at least one beneficiating agent is introduced into said vacuum storage tank.

15. A method in accordance with claim 9 further comprising mechanically mixing said at least one beneficiating agent with said loosened soil and at least one of said vacuum hose and said vacuum storage tank.

* * * * *